US011525562B2

(12) United States Patent
Harvey et al.

(10) Patent No.: US 11,525,562 B2
(45) Date of Patent: Dec. 13, 2022

(54) UTILITY MOUNT LIGHT

(71) Applicant: MILWAUKEE ELECTRIC TOOL CORPORATION, Brookfield, WI (US)

(72) Inventors: Kyle Harvey, Wauwatosa, WI (US); Jason D. Thurner, Menomonee Falls, WI (US); David Proeber, Milwaukee, WI (US); Justin D. Dorman, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/862,844

(22) Filed: Jul. 12, 2022

(65) Prior Publication Data

US 2022/0349560 A1 Nov. 3, 2022

Related U.S. Application Data

(63) Continuation of application No. 17/381,791, filed on Jul. 21, 2021, now Pat. No. 11,448,383, which is a (Continued)

(51) Int. Cl.
*F21V 21/14* (2006.01)
*F21L 4/02* (2006.01)
(Continued)

(52) U.S. Cl.
CPC ..... *F21V 21/145* (2013.01); *F21L 4/027* (2013.01); *F21L 4/04* (2013.01); *F21V 21/0885* (2013.01);
(Continued)

(58) Field of Classification Search
CPC F21L 4/027; F21L 4/04; F21V 21/145; F21V 21/0885; F21V 21/30; F21V 21/406; F21V 23/0414
See application file for complete search history.

(56) References Cited

U.S. PATENT DOCUMENTS 3,331,958 A 7/1967 Adler
3,973,179 A 8/1976 Weber et al.
(Continued)

FOREIGN PATENT DOCUMENTS

CN 303851715 9/2016
DE 10023183 A1 11/2001
(Continued)

OTHER PUBLICATIONS

Extended European Search Report for Application No. 16198619.5 dated Mar. 1, 2017, 9 pages.
(Continued)

*Primary Examiner* — Peggy A Neils
(74) *Attorney, Agent, or Firm* — Michael Best & Friedrich LLP

(57) ABSTRACT

A utility light mountable to a workpiece including a main body having a first end, a second end opposite the first end, and a length extending between the first end and the second end. A light assembly is coupled to the main body and has a light housing and a light source disposed within the light housing. The light housing is pivotable and rotatable relative to the main body. The utility light further includes a battery support portion configured to selectively receive a battery. The battery support portion disposed at the first end of the main body. A handle assembly is coupled to the second end of the main body. The handle assembly has a first member configured to be grasped for carrying and maneuvering the utility light and a second member that is moveable relative to the first member.

20 Claims, 8 Drawing Sheets

Related U.S. Application Data continuation of application No. 16/999,742, filed on Aug. 21, 2020, now Pat. No. 11,073,265, which is a continuation of application No. 16/404,197, filed on May 6, 2019, now Pat. No. 10,753,585, which is a continuation of application No. 15/349,689, filed on Nov. 11, 2016, now Pat. No. 10,323,831.

(60) Provisional application No. 62/255,078, filed on Nov. 13, 2015.

(51) Int. Cl.

| | |
|---|---|
| ***F21V 21/30*** | (2006.01) |
| ***F21V 21/40*** | (2006.01) |
| ***F21L 4/04*** | (2006.01) |
| ***F21V 21/088*** | (2006.01) |
| ***F21V 23/04*** | (2006.01) |

(52) U.S. Cl.

CPC ..... *F21V 21/30* (2013.01); *F21V 21/406* (2013.01); *F21V 23/0414* (2013.01)

(56) References Cited

U.S. PATENT DOCUMENTS

| | | | | |
|---|---|---|---|---|
| 4,032,771 | A | 6/1977 | Ilzig | |
| 4,228,489 | A | 10/1980 | Martin | |
| 4,268,894 | A | 5/1981 | Bartunek et al. | |
| 4,324,477 | A | 4/1982 | Miyazaki | |
| 5,019,951 | A | 5/1991 | Osterhout et al. | |
| 5,203,621 | A | 4/1993 | Weinmeister et al. | |
| 5,207,747 | A | 5/1993 | Gordin et al. | |
| 5,351,172 | A | 9/1994 | Attree et al. | |
| 5,400,234 | A | 3/1995 | Yu | |
| 5,428,520 | A | 6/1995 | Skief | |
| D376,535 | S | 12/1996 | Gary et al. | |
| 5,630,660 | A | 5/1997 | Chen | |
| 5,934,628 | A | 8/1999 | Bosnakovic | |
| 5,944,407 | A | 8/1999 | Lynch et al. | |
| 5,964,524 | A | 10/1999 | Qian | |
| D422,203 | S | 4/2000 | Gary et al. | |
| 6,045,240 | A | 4/2000 | Hochstein | |
| D424,418 | S | 5/2000 | Gary et al. | |
| D428,176 | S | 7/2000 | Bamber et al. | |
| 6,092,911 | A | 7/2000 | Baker, III et al. | |
| 6,099,142 | A | 8/2000 | Liu | |
| 6,149,283 | A | 11/2000 | Conway et al. | |
| 6,183,114 | B1 | 2/2001 | Cook et al. | |
| 6,213,626 | B1 | 4/2001 | Qian | |
| 6,255,786 | B1 | 7/2001 | Yen | |
| 6,265,969 | B1 | 7/2001 | Shih | |
| D452,022 | S | 12/2001 | Osiecki et al. | |
| 6,367,949 | B1 | 4/2002 | Pederson | |
| 6,379,023 | B1 | 4/2002 | Passno | |
| 6,394,631 | B1 | 5/2002 | Yuen | |
| 6,461,017 | B2 | 10/2002 | Selkee | |
| 6,474,844 | B1 | 11/2002 | Ching | |
| 6,554,459 | B2 | 4/2003 | Yu et al. | |
| 6,637,904 | B2 | 10/2003 | Hernandez | |
| D494,849 | S | 8/2004 | Jones et al. | |
| 6,802,623 | B1 * | 10/2004 | Hsu | F21V 21/406 362/205 |
| 6,824,297 | B1 | 11/2004 | Lee | |
| 6,854,862 | B1 | 2/2005 | Hopf | |
| 6,857,756 | B2 | 2/2005 | Reiff et al. | |
| 6,873,249 | B2 | 3/2005 | Chu | |
| 6,877,881 | B2 | 4/2005 | Tsao | |
| 6,899,441 | B2 | 5/2005 | Chen | |
| D506,847 | S | 6/2005 | Hussaini et al. | |
| 6,902,294 | B2 | 6/2005 | Wright | |
| 6,926,428 | B1 | 8/2005 | Lee | |
| 6,953,260 | B1 | 10/2005 | Allen | |
| 7,001,044 | B2 | 2/2006 | Leen | |
| 7,001,047 | B2 | 2/2006 | Holder et al. | |
| 7,011,280 | B2 | 3/2006 | Murray et al. | |
| 7,063,444 | B2 | 6/2006 | Lee et al. | |
| 7,073,926 | B1 | 7/2006 | Kremers et al. | |
| D529,360 | S | 10/2006 | Wimmer | |
| D529,926 | S | 10/2006 | Krieger et al. | |
| D532,536 | S | 11/2006 | Krieger et al. | |
| 7,152,997 | B1 | 12/2006 | Kovacik et al. | |
| 7,153,004 | B2 | 12/2006 | Galli | |
| D537,330 | S | 2/2007 | Cox et al. | |
| D538,636 | S | 3/2007 | Jackson et al. | |
| 7,194,358 | B2 | 3/2007 | Callaghan et al. | |
| 7,195,377 | B2 | 3/2007 | Tsai | |
| 7,224,271 | B2 | 5/2007 | Wang | |
| D549,859 | S | 8/2007 | Kovacik et al. | |
| D551,048 | S | 9/2007 | Huang | |
| D551,532 | S | 9/2007 | Huang | |
| D553,281 | S | 10/2007 | Rugendyke et al. | |
| D553,461 | S | 10/2007 | Neiser | |
| D553,771 | S | 10/2007 | Watson et al. | |
| 7,278,761 | B2 | 10/2007 | Kuan | |
| D556,353 | S | 11/2007 | Gebhard et al. | |
| 7,350,940 | B2 | 4/2008 | Haugaared et al. | |
| 7,364,320 | B2 | 4/2008 | Van Deursen et al. | |
| 7,367,695 | B2 | 5/2008 | Shiau | |
| 7,470,036 | B2 | 12/2008 | Deighton et al. | |
| 7,484,858 | B2 | 2/2009 | Deighton | |
| 7,503,530 | B1 | 3/2009 | Brown | |
| D593,236 | S | 5/2009 | Ng et al. | |
| D595,105 | S | 6/2009 | White | |
| 7,566,151 | B2 | 7/2009 | Whelan et al. | |
| 7,618,154 | B2 | 11/2009 | Rosiello | |
| 7,638,970 | B1 | 12/2009 | Gebhard et al. | |
| 7,670,034 | B2 | 3/2010 | Zhang et al. | |
| 7,798,684 | B2 | 9/2010 | Boissevain | |
| 7,828,465 | B2 | 11/2010 | Roberge et al. | |
| 7,857,486 | B2 | 12/2010 | Long | |
| 7,914,178 | B2 | 3/2011 | Xiang et al. | |
| 7,914,182 | B2 | 3/2011 | Mrakovich et al. | |
| 7,972,036 | B1 | 7/2011 | Schach et al. | |
| D643,138 | S | 8/2011 | Kawase et al. | |
| 7,988,335 | B2 | 8/2011 | Liu et al. | |
| 7,990,062 | B2 | 8/2011 | Liu | |
| 7,997,753 | B2 | 8/2011 | Walesa | |
| 8,007,128 | B2 | 8/2011 | Wu et al. | |
| 8,007,145 | B2 | 8/2011 | Leen | |
| 8,029,169 | B2 | 10/2011 | Liu | |
| 8,047,481 | B2 | 11/2011 | Shen | |
| 8,087,797 | B2 | 1/2012 | Pelletier et al. | |
| 8,142,045 | B2 | 3/2012 | Peak | |
| 8,167,466 | B2 | 5/2012 | Liu | |
| 8,201,979 | B2 | 6/2012 | Deighton et al. | |
| D665,521 | S | 8/2012 | Werner et al. | |
| 8,235,552 | B1 | 8/2012 | Tsuge | |
| 8,262,246 | B2 | 9/2012 | Pelletier et al. | |
| 8,262,248 | B2 | 9/2012 | Wessel | |
| 8,294,340 | B2 | 10/2012 | Yu et al. | |
| 8,322,892 | B2 | 12/2012 | Scordino et al. | |
| 8,328,398 | B2 | 12/2012 | Van Deursen | |
| 8,330,337 | B2 | 12/2012 | Yu et al. | |
| 8,360,607 | B2 | 1/2013 | Bretschneider et al. | |
| 8,366,290 | B2 | 2/2013 | Maglica | |
| 8,403,522 | B2 | 3/2013 | Chang | |
| D679,845 | S | 4/2013 | Huang | |
| 8,425,091 | B2 | 4/2013 | Chen | |
| 8,434,915 | B2 | 5/2013 | Liu et al. | |
| 8,439,531 | B2 | 5/2013 | Trott et al. | |
| 8,465,178 | B2 | 6/2013 | Wilcox et al. | |
| 8,485,691 | B2 | 7/2013 | Hamel et al. | |
| 8,547,022 | B2 | 10/2013 | Summerford et al. | |
| D695,434 | S | 12/2013 | Shen | |
| 8,599,097 | B2 | 12/2013 | Intravatola | |
| D698,471 | S | 1/2014 | Poon | |
| D699,874 | S | 2/2014 | Chilton et al. | |
| 8,651,438 | B2 | 2/2014 | Deighton et al. | |
| 8,659,433 | B2 | 2/2014 | Petrou | |
| 8,668,349 | B2 | 3/2014 | Richardson | |
| D702,863 | S | 4/2014 | Kotsis | |
| D703,354 | S | 4/2014 | Kotsis | |
| D703,355 | S | 4/2014 | Kotsis | |

(56) References Cited

U.S. PATENT DOCUMENTS

| | | | |
|---|---|---|---|
| D703,851 | S | 4/2014 | Gebhard et al. |
| 8,692,444 | B2 | 4/2014 | Patel et al. |
| 8,696,177 | B1 | 4/2014 | Frost |
| D705,467 | S | 5/2014 | Aglassinger |
| 8,757,815 | B2 | 6/2014 | Saruwatari et al. |
| D708,376 | S | 7/2014 | Crowe et al. |
| 8,801,226 | B2 | 8/2014 | Moore |
| 8,840,264 | B2 | 9/2014 | Molina et al. |
| 8,851,699 | B2 | 10/2014 | McMillan |
| 8,858,016 | B2 | 10/2014 | Strelchuk |
| 8,858,026 | B2 | 10/2014 | Lee et al. |
| 8,939,602 | B2 | 1/2015 | Wessel |
| 8,979,331 | B2 | 3/2015 | Lee et al. |
| D726,354 | S | 4/2015 | Davies |
| 9,010,279 | B1 | 4/2015 | Saber et al. |
| D728,402 | S | 5/2015 | Case |
| 9,046,231 | B2 | 6/2015 | Christ et al. |
| 9,052,072 | B2 | 6/2015 | Renk, Jr. |
| 9,068,736 | B2 | 6/2015 | Lee et al. |
| D734,886 | S | 7/2015 | Lazalier et al. |
| D737,487 | S | 8/2015 | Beckett et al. |
| D744,139 | S | 11/2015 | Itoh et al. |
| 9,188,320 | B2 | 11/2015 | Russello et al. |
| 9,205,774 | B2 | 12/2015 | Kennemer et al. |
| D747,263 | S | 1/2016 | Lafferty |
| D750,822 | S | 3/2016 | Hernandez et al. |
| D755,034 | S | 5/2016 | DeBaker et al. |
| D759,291 | S | 6/2016 | Chen |
| D772,670 | S | 11/2016 | Barezzani et al. |
| D774,231 | S | 12/2016 | Recker et al. |
| D774,674 | S | 12/2016 | Hanwell |
| D776,320 | S | 1/2017 | Bobel |
| 9,539,952 | B2 | 1/2017 | Gebhard et al. |
| D779,694 | S | 2/2017 | Crowe et al. |
| 9,579,735 | B2 | 2/2017 | Wattenbach et al. |
| D781,480 | S | 3/2017 | Zhan |
| D781,718 | S | 3/2017 | Ko |
| 9,596,776 | B2 | 3/2017 | Takahashi et al. |
| D788,180 | S | 5/2017 | Mantes et al. |
| D804,074 | S | 11/2017 | Fang |
| D805,365 | S | 12/2017 | Ballard et al. |
| D816,252 | S | 4/2018 | Harvey et al. |
| D823,088 | S | 7/2018 | Laavour et al. |
| D824,246 | S | 7/2018 | Ming |
| 10,323,831 | B2 | 6/2019 | Harvey et al. |
| 10,571,102 | B1 | 2/2020 | Bao |
| D877,948 | S | 3/2020 | Thompson |
| D881,431 | S | 4/2020 | Burczyk et al. |
| 10,948,166 | B2 | 3/2021 | Ohara et al. |
| 2002/0136005 | A1 | 9/2002 | Lee |
| 2002/0167814 | A1 | 11/2002 | Ching |
| 2003/0090904 | A1 | 5/2003 | Ching |
| 2003/0137847 | A1 | 7/2003 | Cooper |
| 2003/0174503 | A1 | 9/2003 | Yueh |
| 2004/0228117 | A1 | 11/2004 | Witzel et al. |
| 2005/0201085 | A1 | 9/2005 | Aikawa et al. |
| 2006/0007682 | A1 | 1/2006 | Reiff, Jr. et al. |
| 2006/0067077 | A1 | 3/2006 | Kumthampinij et al. |
| 2006/0146550 | A1 | 7/2006 | Simpson et al. |
| 2006/0279948 | A1 | 12/2006 | Tsai |
| 2006/0285323 | A1 | 12/2006 | Fowler |
| 2007/0211470 | A1 | 9/2007 | Huang |
| 2007/0297167 | A1 | 12/2007 | Greenhoe |
| 2008/0112170 | A1 | 5/2008 | Trott et al. |
| 2008/0158887 | A1 | 7/2008 | Zhu et al. |
| 2008/0165537 | A1 | 7/2008 | Shiau |
| 2008/0198588 | A1 | 8/2008 | O'Hern |
| 2008/0253125 | A1 | 10/2008 | Kang et al. |
| 2008/0302933 | A1 | 12/2008 | Cardellini |
| 2009/0080205 | A1 | 3/2009 | Chang et al. |
| 2009/0097263 | A1 | 4/2009 | Ko et al. |
| 2009/0116230 | A1 | 5/2009 | Young |
| 2009/0134191 | A1 | 5/2009 | Phillips |
| 2009/0135594 | A1 | 5/2009 | Yu et al. |
| 2009/0284963 | A1 | 11/2009 | Intravatola |
| 2009/0303717 | A1 | 12/2009 | Long et al. |
| 2010/0027260 | A1 | 2/2010 | Liu |
| 2010/0027269 | A1 | 2/2010 | Lo et al. |
| 2010/0072897 | A1 | 3/2010 | Zheng |
| 2010/0080005 | A1 | 4/2010 | Gattar |
| 2010/0091495 | A1 | 4/2010 | Patrick |
| 2010/0132203 | A1 | 6/2010 | Green et al. |
| 2010/0142213 | A1 | 6/2010 | Bigge et al. |
| 2010/0315824 | A1 | 12/2010 | Chen |
| 2010/0328951 | A1 | 12/2010 | Boissevain |
| 2011/0031887 | A1 | 2/2011 | Stoll et al. |
| 2011/0038144 | A1 | 2/2011 | Chang |
| 2011/0050070 | A1 | 3/2011 | Pickard |
| 2011/0058367 | A1 | 3/2011 | Shiau et al. |
| 2011/0075404 | A1 | 3/2011 | Allen et al. |
| 2011/0121727 | A1 | 5/2011 | Sharrah et al. |
| 2011/0228524 | A1 | 9/2011 | Greer |
| 2011/0286216 | A1 | 11/2011 | Araman |
| 2011/0317420 | A1 | 12/2011 | Jeon et al. |
| 2012/0026729 | A1 | 2/2012 | Sanchez et al. |
| 2012/0033400 | A1 | 2/2012 | Remus et al. |
| 2012/0033429 | A1 | 2/2012 | Van De Ven |
| 2012/0044707 | A1 | 2/2012 | Breidenassel |
| 2012/0048511 | A1 | 3/2012 | Moshtag |
| 2012/0049717 | A1 | 3/2012 | Lu |
| 2012/0057351 | A1 | 3/2012 | Wilcox et al. |
| 2012/0087118 | A1 | 4/2012 | Bailey et al. |
| 2012/0087125 | A1 | 4/2012 | Liu |
| 2012/0098437 | A1 | 4/2012 | Smed |
| 2012/0120674 | A1 | 5/2012 | Jonker |
| 2012/0140455 | A1 | 6/2012 | Chang et al. |
| 2012/0155104 | A1 | 6/2012 | Jonker |
| 2012/0212963 | A1 | 8/2012 | Jigamain |
| 2012/0234519 | A1 | 9/2012 | Lee |
| 2012/0236551 | A1 | 9/2012 | Sharrah et al. |
| 2012/0247735 | A1 | 10/2012 | Ito et al. |
| 2012/0262917 | A1 | 10/2012 | Courcelle |
| 2012/0300487 | A1 | 11/2012 | Jonker |
| 2013/0032323 | A1 | 2/2013 | Hsu |
| 2013/0058078 | A1 | 3/2013 | Meng |
| 2013/0077296 | A1 | 3/2013 | Goeckel et al. |
| 2013/0128565 | A1 | 5/2013 | Cugini et al. |
| 2013/0148366 | A1 | 6/2013 | Adams, IV et al. |
| 2013/0176713 | A1 | 7/2013 | Deighton et al. |
| 2013/0187785 | A1 | 7/2013 | McIntosh et al. |
| 2013/0258645 | A1 | 10/2013 | Weber et al. |
| 2013/0265780 | A1 | 10/2013 | Choski et al. |
| 2013/0322073 | A1 | 12/2013 | Hamm et al. |
| 2014/0126192 | A1 | 5/2014 | Ancona et al. |
| 2014/0140050 | A1 | 5/2014 | Wong et al. |
| 2014/0192543 | A1 | 7/2014 | Deighton et al. |
| 2014/0218936 | A1 | 8/2014 | Mahling et al. |
| 2014/0231486 | A1 | 8/2014 | Burch et al. |
| 2014/0268775 | A1 | 9/2014 | Kennemer et al. |
| 2014/0301066 | A1 | 10/2014 | Inskeep |
| 2014/0307443 | A1 | 10/2014 | Clifford et al. |
| 2014/0376216 | A1 | 12/2014 | McLoughlin et al. |
| 2015/0023771 | A1 | 1/2015 | Carr et al. |
| 2015/0198298 | A1 | 7/2015 | Scarlata et al. |
| 2015/0233569 | A1 | 8/2015 | Xue et al. |
| 2015/0233571 | A1 | 8/2015 | Inan et al. |
| 2016/0341239 | A1 | 11/2016 | Inkavesvaanit |
| 2016/0354664 | A1 | 12/2016 | DeCarlo |
| 2016/0356439 | A1 | 12/2016 | Inskeep |
| 2017/0138575 | A1 | 5/2017 | Harvey et al. |
| 2017/0204864 | A1 | 7/2017 | Mantes et al. |
| 2017/0331163 | A1 | 11/2017 | Ebner et al. |
| 2019/0257505 | A1 | 8/2019 | Harvey et al. |
| 2019/0285257 | A1 | 9/2019 | Gall et al. |
| 2020/0378586 | A1 | 12/2020 | Harvey et al. |

FOREIGN PATENT DOCUMENTS

| | | | |
|---|---|---|---|
| EP | 0193756 | A2 | 9/1986 |
| EP | 1205428 | A1 | 5/2002 |
| EP | 2436641 | A1 | 4/2012 |
| GB | 2424694 | A | 10/2006 |
| GB | 2468740 | A | 9/2010 |
| KR | 20100116933 | A | 11/2010 |

(56) References Cited

FOREIGN PATENT DOCUMENTS

| | | | |
|---|---|---|---|
| WO | 2002044503 | A1 | 6/2002 |
| WO | 2014083117 | A1 | 6/2014 |
| WO | 2014207595 | A1 | 12/2014 |

OTHER PUBLICATIONS

European Patent Office Action for Application No. 16198619.5 dated May 18, 2018, 5 pages.
Milwaukee Tool, "M18 Utility Bucket Light (Tool Only)", <https:www.milwaukeetool.com/Products/Lighting/Specialty-Lights/2122-22HD>, website accessed Dec. 30, 2019, 5 pages.

* cited by examiner

UTILITY MOUNT LIGHT

CROSS-REFERENCE TO RELATED APPLICATIONS

This application is a continuation of prior-filed, U.S. patent application Ser. No. 17/381,791, filed on Jul. 21, 2021, now U.S. Pat. No. 11,448,383, which is a continuation of U.S. patent application Ser. No. 16/999,742, filed on Aug. 21, 2020, now U.S. Pat. No. 11,073,265, which is a continuation of U.S. patent application Ser. No. 16/404,197, filed on May 6, 2019, now U.S. Pat. No. 10,753,585, which is a continuation of U.S. patent application Ser. No. 15/349,689, filed on Nov. 11, 2016, now U.S. Pat. No. 10,323,831, which claims priority to U.S. Provisional Patent Application No. 62/255,078, filed on Nov. 13, 2015, the entire contents of all of which are incorporated herein by reference.

FIELD OF THE INVENTION

The present invention relates to utility lights.

SUMMARY OF THE INVENTION

The present invention provides, in one aspect, a utility light comprising a main body and a light assembly defined on the main body including a light source disposed within a light housing. The light housing is pivotable and rotatable relative to the main body. The utility light also comprises a handle movably coupled to the main body. The handle is linearly extensible relative to the main body to a position in which an opening is defined between the handle and the main body, such that the opening is configured to receive a workpiece to support the utility light. The handle has a gripping portion defined by an aperture extending through the handle.

The present invention provides, in another aspect, a utility light comprising a main body and a light assembly defined on the main body including a light source disposed within a light housing. The light housing is pivotable and rotatable relative to the main body. The utility light also comprises a handle including a portion that is movably coupled to the main body. The handle is linearly extensible relative to the main body and biased toward the main body such that the handle is configured to clamp a workpiece between the handle and the main body.

The present invention provides, in yet another aspect, a utility light comprising a main body and a handle movably coupled to the main body. The handle linearly extensible in a first direction relative to the main body and biased toward the main body in a second direction that is opposite the first direction. The utility light also comprises a light assembly defined on the main body including a light source disposed within a light housing, the light housing being pivotally supported within a yoke that is rotatable relative to the main body.

Other features and aspects of the invention will become apparent by consideration of the following detailed description and accompanying drawings.

Figure 1:
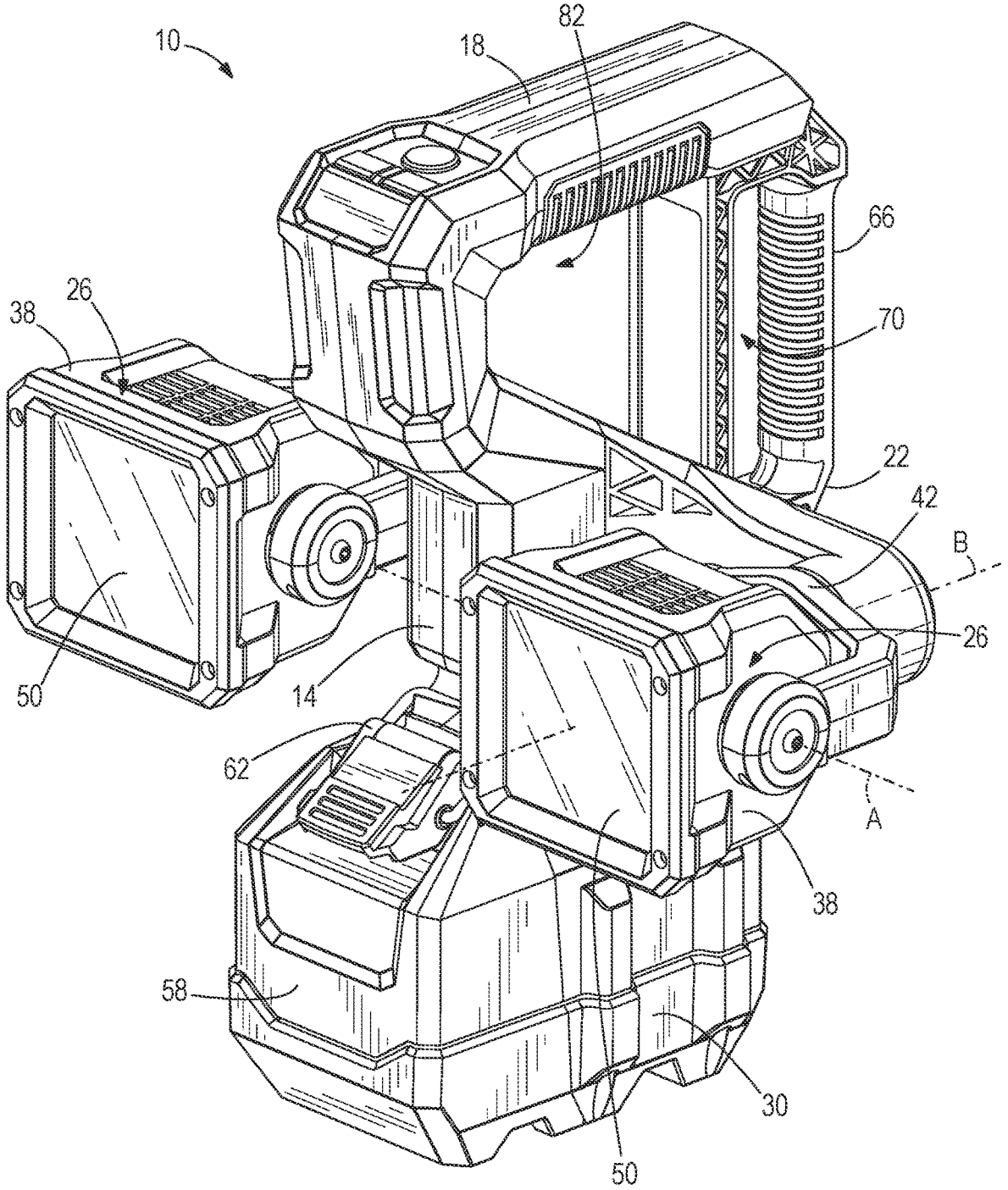
FIG. 1 is a front perspective view of a utility mount light.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-5 illustrate a utility mount light 10 including a main housing 14, a handle portion 18 supporting a handle 22, a pair of rotatable light head assemblies 26, and a battery support portion 30 configured to detachably couple a battery pack (not shown). As explained in greater detail below, the utility mount light 10 is configured to be attached to a bucket of an elevated work platform (i.e., boom lift, man lift, basket crane, hydraladder, cherry picker, etc.), other components such as tables, or to a workpiece using the handle 22. For convenience, the component to which the light 10 attaches will hereinafter be referred to as a workpiece. Once the light 10 is mounted to the workpiece, the rotatable light head assemblies 26 may be rotated as desired to illuminate a work area.

Figure 2:
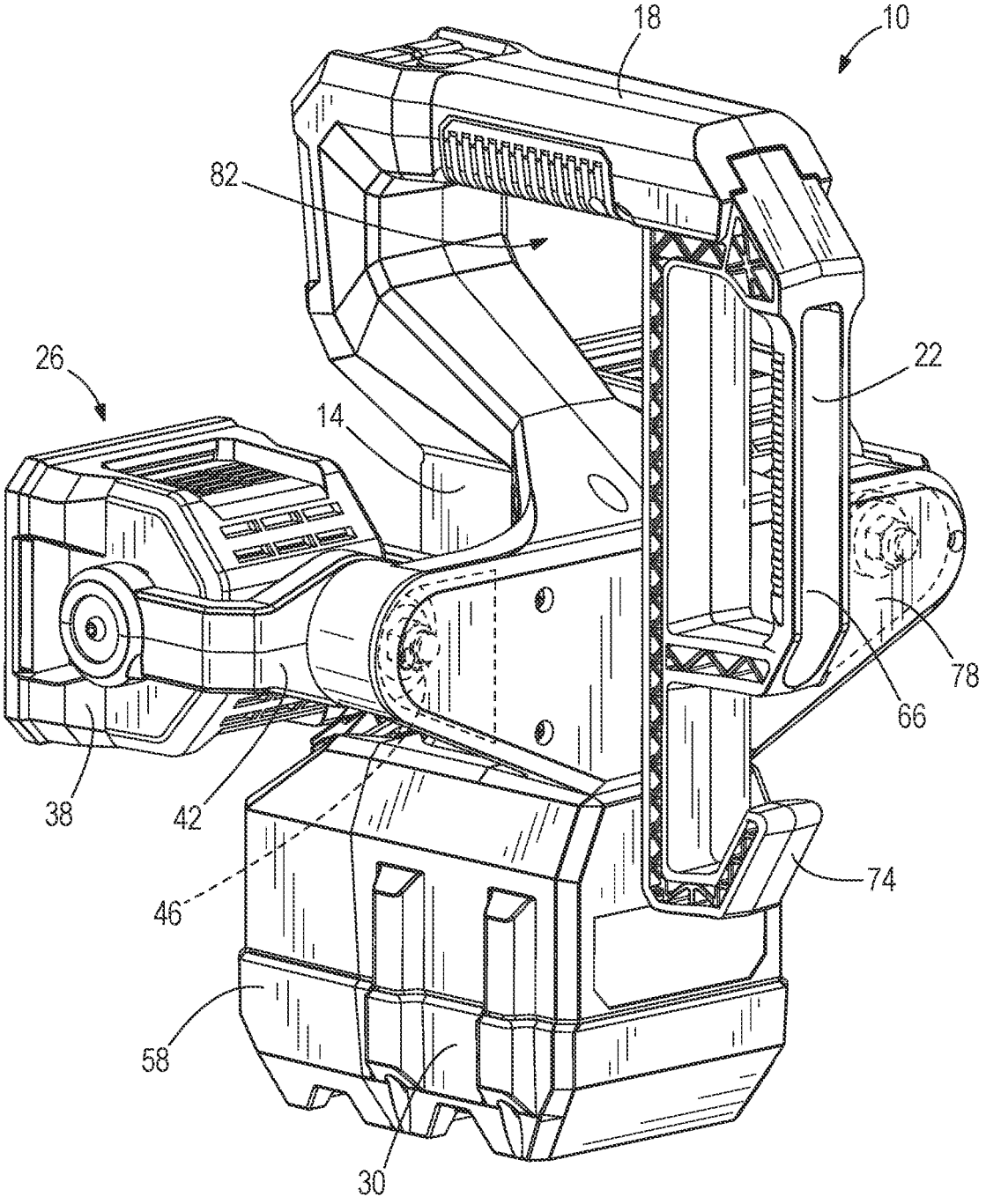
FIG. 2 is a rear perspective view of the utility mount light.

With reference to FIGS. 1 and 2, the light assemblies 26 each include a light housing 38 that is pivotally coupled between two opposed arms of a yoke 42 for pivoting motion about a first pivot axis A such that a direction of the light housing 38 is adjustable by a user. Each of the light housings 38 is independently rotatable to enhance the ability to direct the light as desired. In one embodiment, a pivoting range of the light housing 38 within the yoke 42 may be limited to approximately 180° about the first pivot axis A (e.g., via stops within the yoke 42). In another embodiment, the light housing 38 may pivot 360° about the first pivot axis A within the yoke 42. In other embodiments, the light housing 38 may have a discrete pivot range about the first pivot axis A within the yoke 42 (e.g., any discrete pivot range between 0-360°).

The yoke 42 is further coupled to the main housing 14 via a joint 46 that may be rotatable about a second pivot axis B that is orthogonal to the first pivot axis A such that a rotational orientation of the yoke 42 is adjustable by a user. In some embodiments, the yoke 42 is coupled to the main housing via a joint 46 that is rotatable 360° about the second pivot axis B. In other embodiments, the yoke 42 is coupled to the main housing 14 via a joint 46 that limits rotation (e.g., using stops in the joint 46). For example, rotation may be limited to discrete angles less than 360° but more than 180°, or rotation may be limited to discrete angles less than or equal to 180°. These configurations allow the light assemblies 26 to be directed in a variety of directions and orientations, and also allow the light assemblies 26 to be movable independently of one another.

In one embodiment, the light housing 38 may be fixed within the yoke 42 (i.e., the light housing is not pivotable) while the yoke 42 is rotatably coupled to the main housing 14 via a joint 46 that permits rotation as described above. In another embodiment, the yoke 42 may be fixedly coupled to the main housing 14 (i.e., the yoke 42 is not rotatable) while the light housing 38 is pivotable within the yoke 42 as described above. In yet another embodiment, the light housing 38 may be fixed within the yoke 42 (i.e., the light housing is not pivotable) and the yoke 42 may be fixedly coupled to the main housing 14 (i.e., the yoke 42 is not rotatable).

Figure 3:
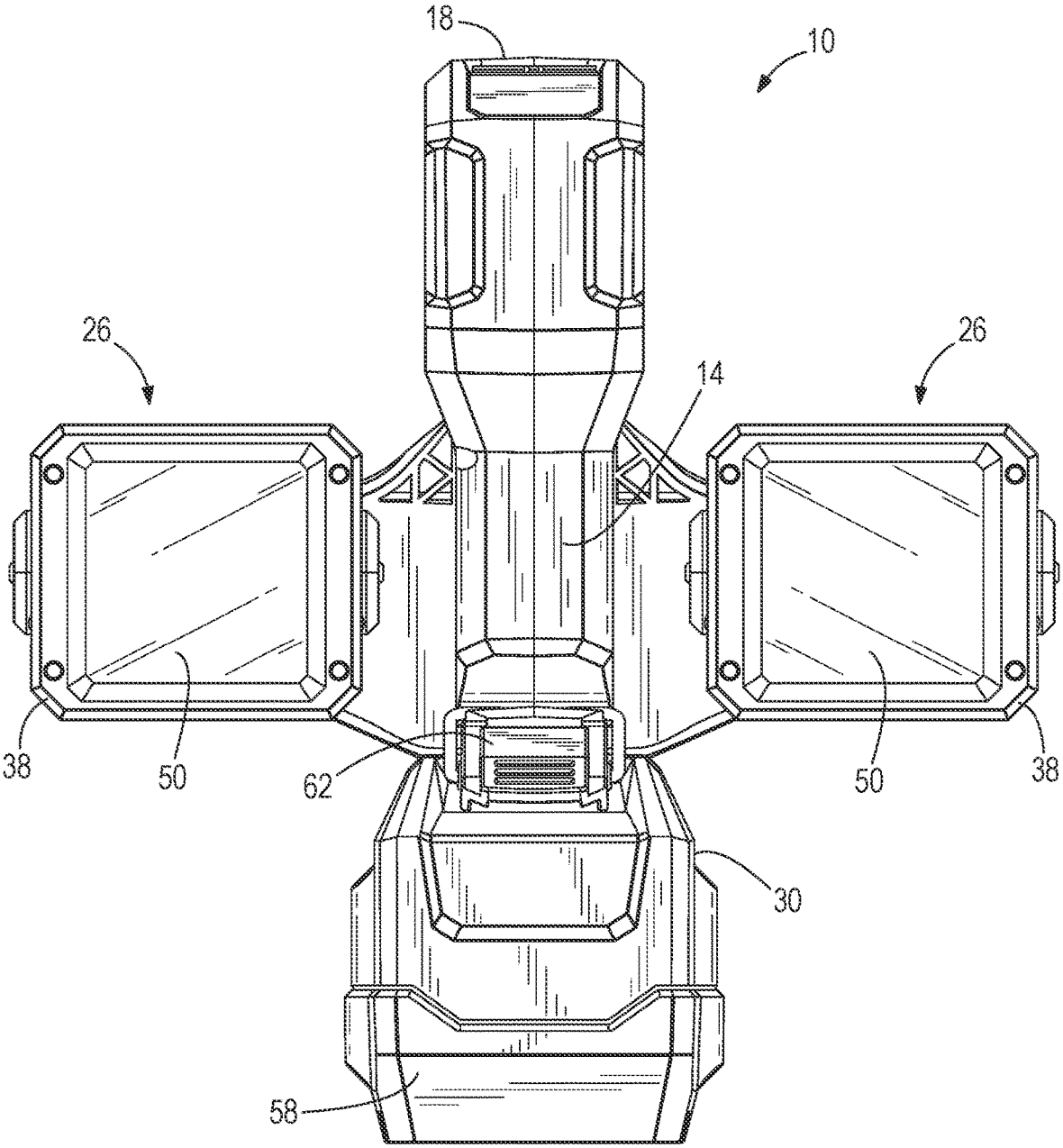
FIG. 3 is a front view of the utility mount light.

As seen in FIG. 3, the light assemblies 26 are disposed on opposing sides of the main housing 14 and the battery support portion 30.

The light housings 38 further support a plurality of lights. The lights may be, for example, spot LEDs, flood LEDs, a fluorescent bulb, an incandescent bulb, or any other suitable lighting elements. In a preferred embodiment, the lights supported within the light housing 30 are a combination of multiple spot LEDs and/or multiple flood LEDs configured to be operated separately and/or in tandem. The lights may be surrounded by a light guide disposed within the housing that directs light through lenses 50 of the light assemblies 26.

Figure 6:
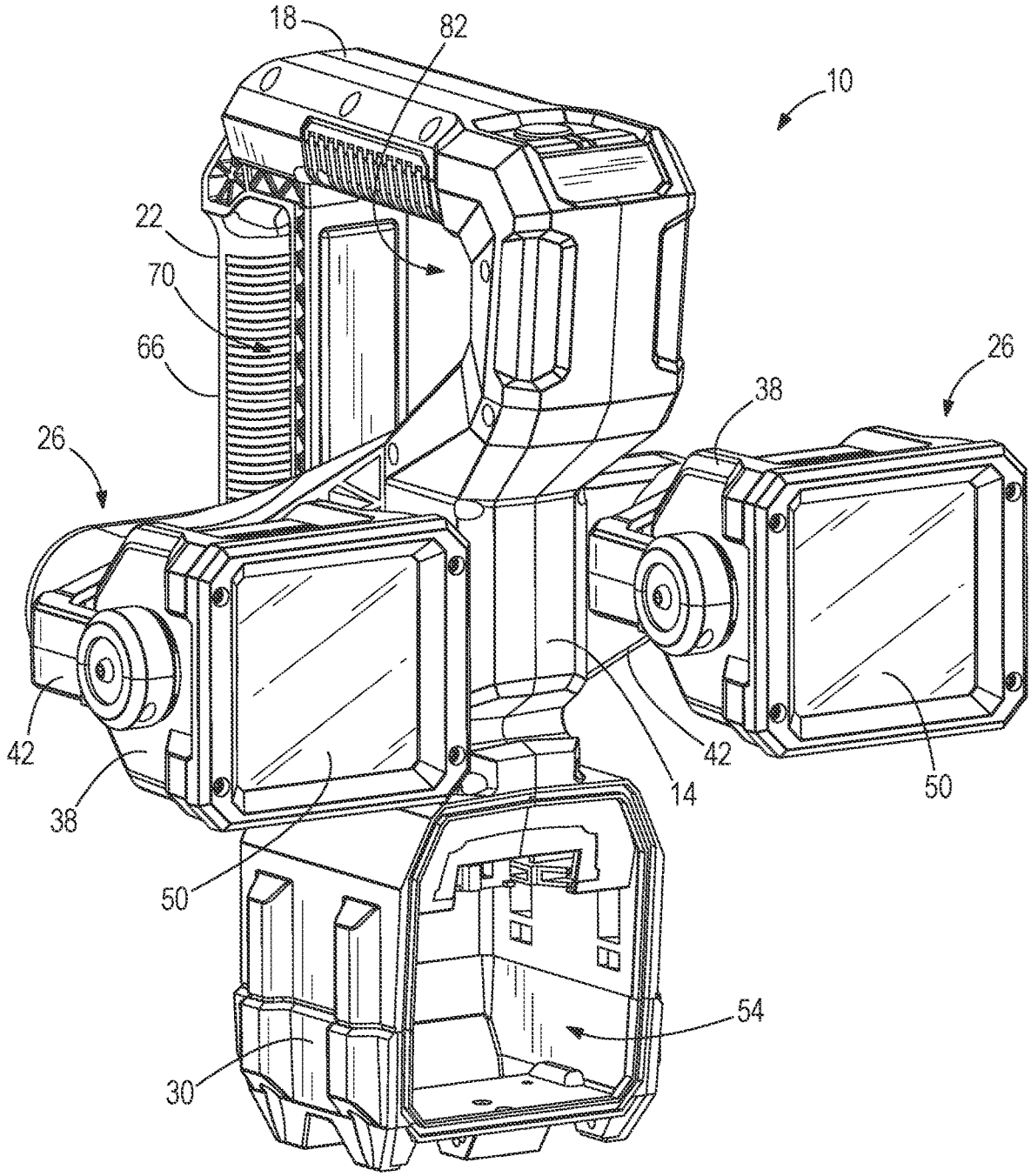
FIG. 6 is a second front perspective view with a door of a battery support portion of the utility mount light removed.

With reference to FIGS. 1 and 6, the battery support portion 30 is formed as one piece with the main housing 14 and is configured to detachably couple the battery pack. In the illustrated embodiment, the battery support portion 30 defines a cavity 54 for receiving the battery pack (FIG. 6). A door 58 is pivotally coupled to the battery support portion 30 at an open end of the cavity, and is releasably secured to the casing via a latch 62. The door 58 is further configured to sealingly engage the open end of the cavity such that, when the battery pack is secured within the cavity 54, no water or contaminants may enter the cavity 54. The sealed engagement may be accomplished by, for example, providing a gasket, an O-ring, a deformable member, or other sealing member to one or both of the battery support portion 30 and the door 58. In preferred constructions, the battery pack is a power tool battery pack.

With reference to FIG. 1, the handle portion 18 includes a power actuator, a first mode actuator, and a second mode actuator (e.g., buttons, trigger switches, knobs, etc.). Each of the actuators may be coupled to a processor supported within the utility mount light 10. The processor is coupled to the lights within each of the light housings 38 and to the battery pack control to the power supplied by the battery pack to each of the light assemblies. In some constructions, some or all of the actuators may be virtual controls (e.g., touch screens) rather than real buttons, switches, or knobs.

The processor is implemented as a microprocessor including a non-transitory, computer-readable memory that stores executable instructions to carry out functionalities of the utility mount light 10. The processor 12 may be implemented partially or entirely as, for example, a field-programmable gate array (FPGA), and application specific integrated circuit (ASIC).

The power actuator may be operated by a user to simultaneously turn both light assemblies 26 on or off. The first mode actuator may be successively operated by a user to cycle one of the light assemblies 26 through a plurality of modes, and the second mode actuator may be successively operated by a user to cycle the other light assembly 26 through the plurality of modes. The plurality of modes may include, for example, a spot mode in which spot LEDs are activated, a flood mode in which flood LEDs are activated, spot/flood mode in which both spot LEDs and flood LEDs are activated, and an off mode (i.e., such that each light assembly 26 may be independently turned off). In one embodiment, the plurality of modes may further include brightness modes for one or more of the spot mode, the flood mode, and the spot/flood mode. In another embodiment, the plurality of modes may be a multiple discrete brightness modes (e.g., low/medium/high, etc.).

In another embodiment, the utility mount light 10 may include separate power actuators for each light, such that there is a first power actuator, a second power actuator, a first mode switch, and a second mode switch. In such an embodiment, the first power actuator controls the on/off state of one of the light assemblies 26, while the second power actuator controls the on/off state of the other light assembly 26.

In yet another embodiment, the utility mount light may include a first actuator and a second actuator. In this embodiment, the first actuator is configured to operate one of the light assemblies 26 while the second actuator is configured to operate the other light assembly. The first actuator may be successively operated by a user to turn the light assembly 26 on, cycle the light assembly 26 through a plurality of modes, and turn the light assembly 26 off. The second actuator may be successively operated by a user to turn the other light assembly 26 on, cycle the other light assembly 26 through a plurality of modes, and turn the other light assembly 26 off.

In any of the embodiments described above, it should be clear that each light assembly 26 may be individually operated (i.e., turned on/off) and/or individually cycled through the plurality of modes such that the light assemblies 26 may be in independent operating states.

Figure 4:
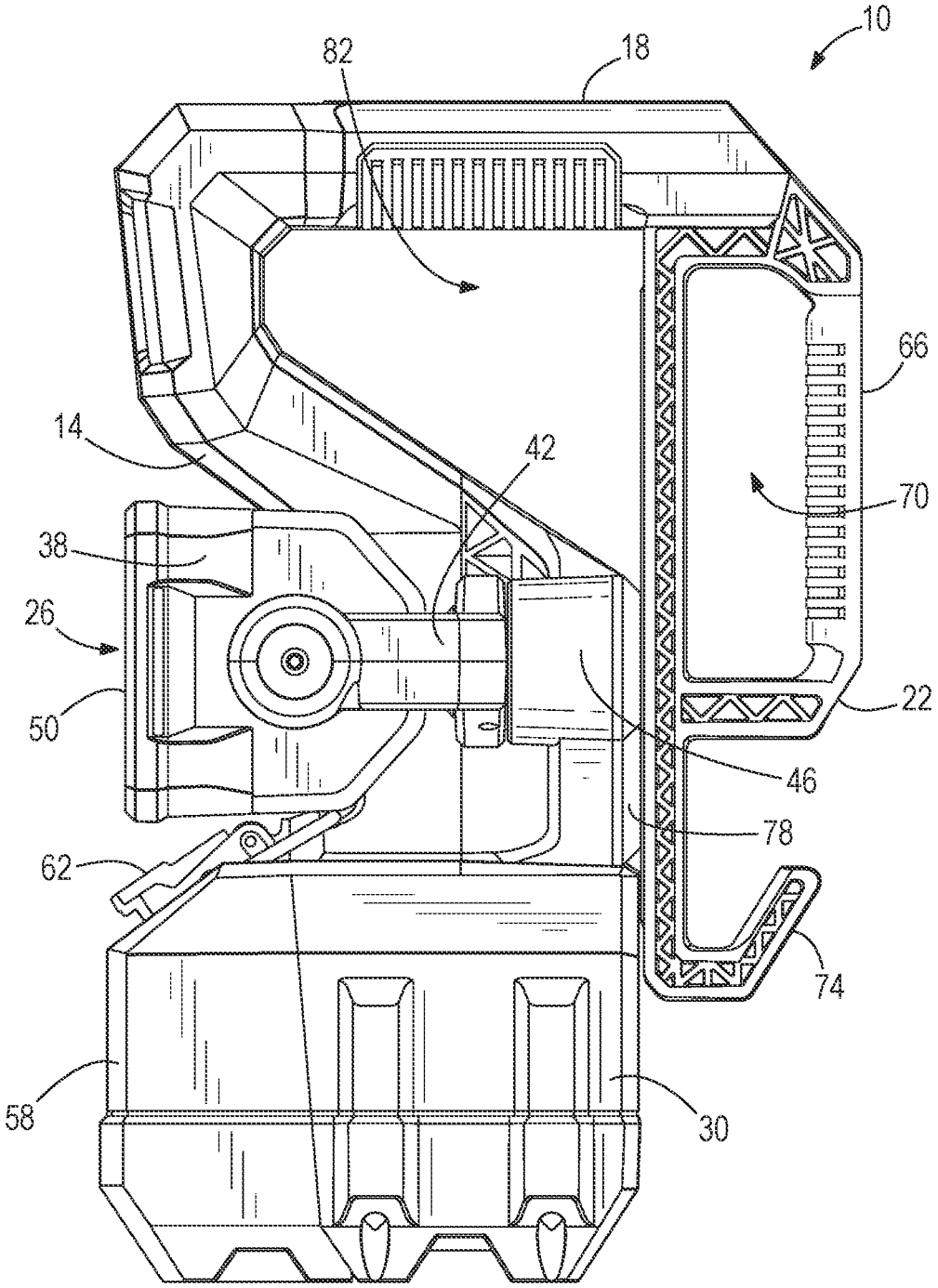
FIG. 4 is a side view of the utility mount light.
Figure 5:
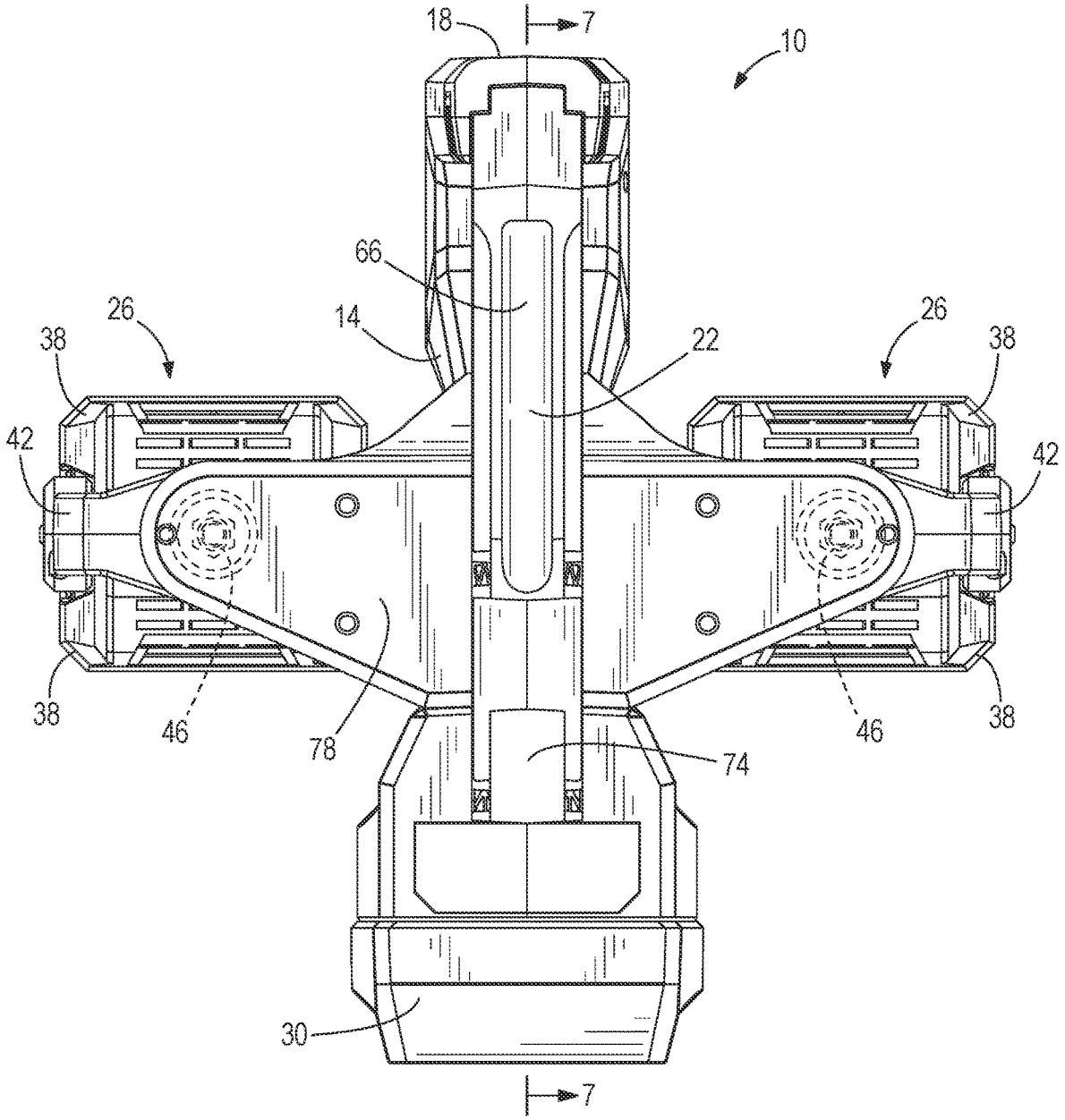
FIG. 5 is a rear view of the utility mount light.
Figure 7:
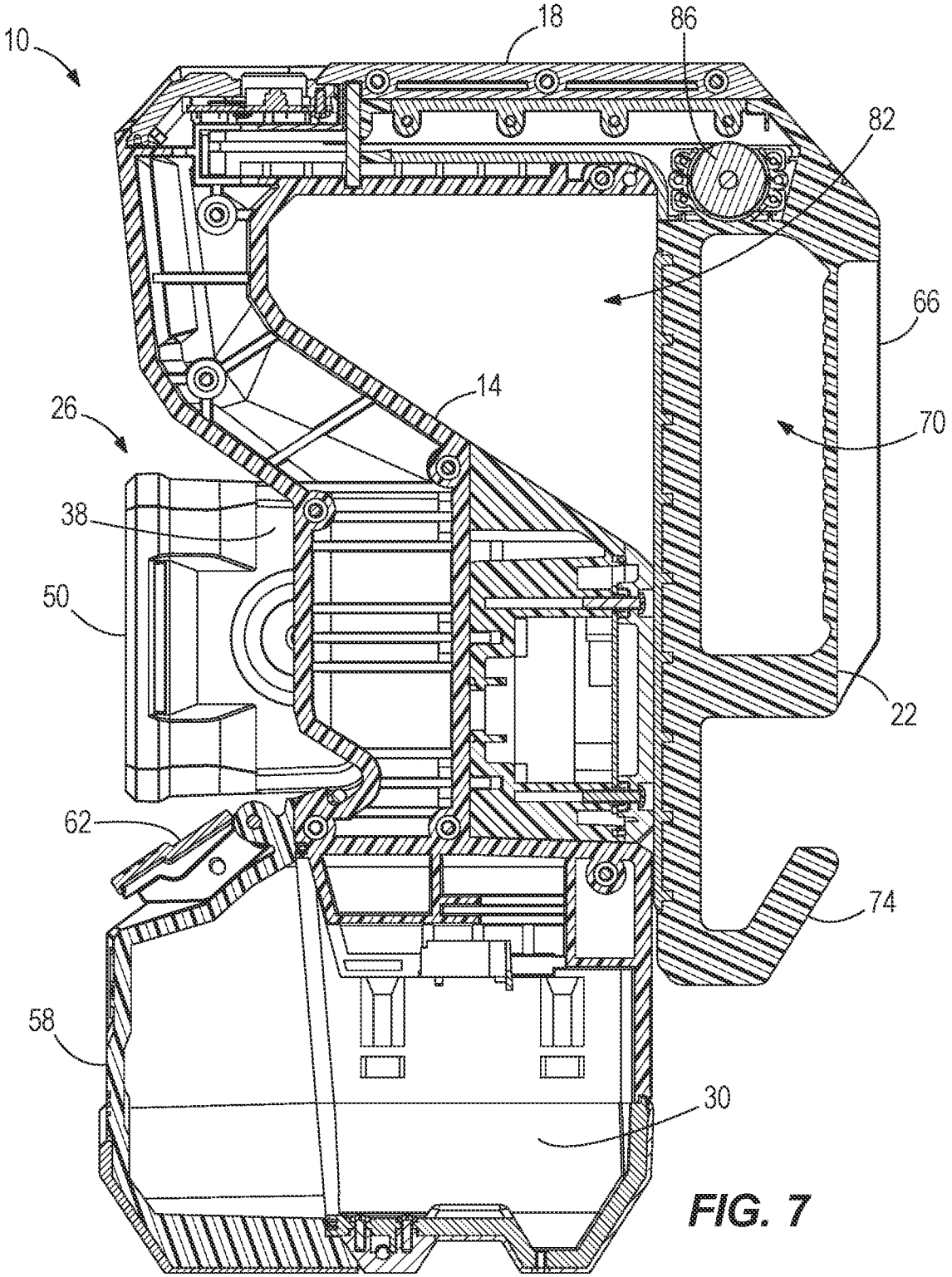
FIG. 7 is a side view of a cross section taken along line 7-7 in FIG. 3.
Figure 8:
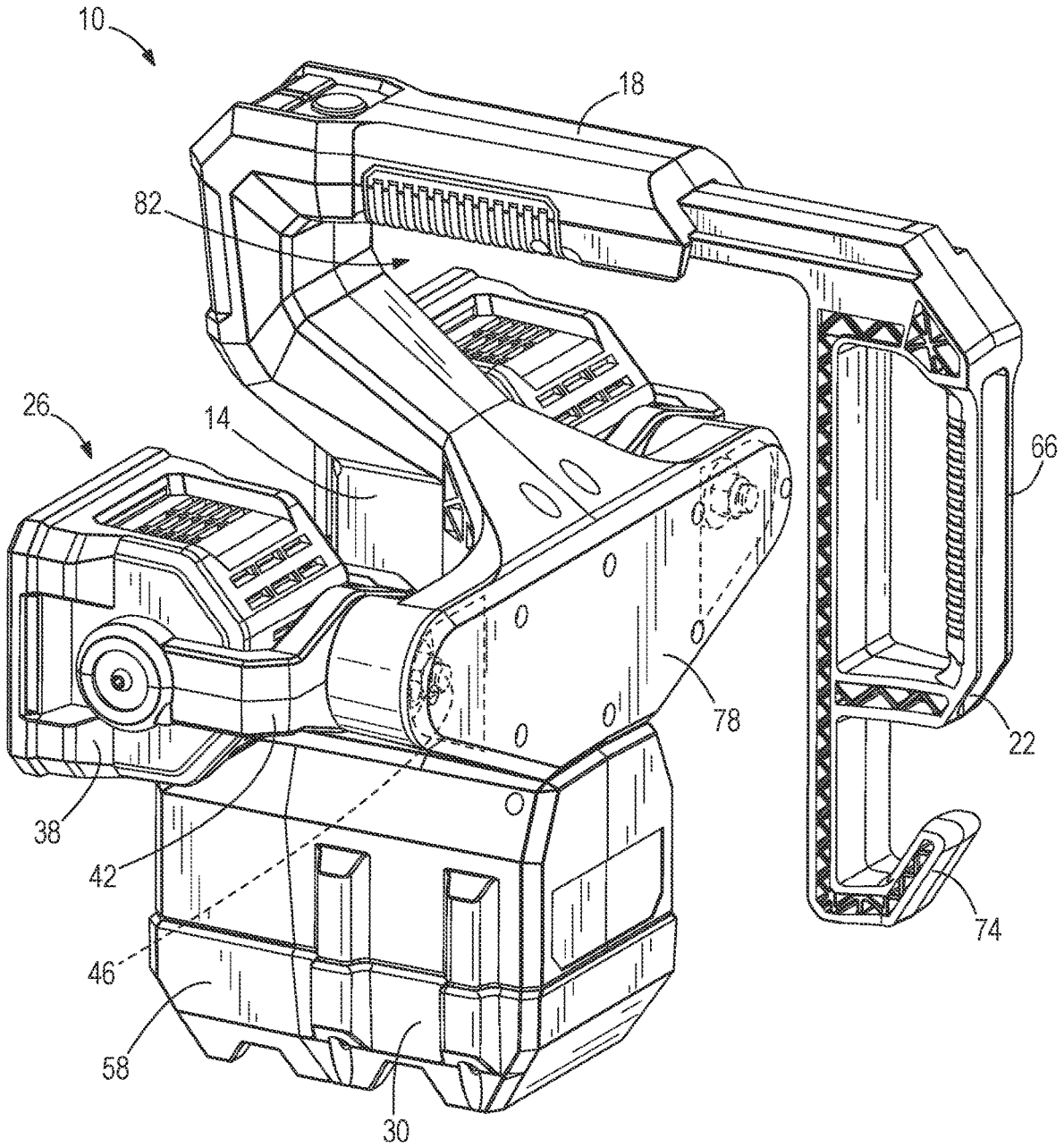
FIG. 8 is a perspective view of the utility mount light with the handle in an open or extended position.

With reference to FIGS. 2 and 4, the handle 22 includes a gripping portion 66 defined by an aperture 70 extending through the handle 22, and a hook portion 74 adjacent the gripping portion 66. The handle 22 is movably coupled to the handle portion 18 at an end adjacent the gripping portion 66, and is biased by a constant force or a clock spring 86 (FIG. 7) toward a closed position (FIG. 4) where the handle 22 maintains contact with a workpiece and/or an opposing support surface 78 disposed on the main housing 14. However, in other embodiments, other biasing members such as a torsion spring, a helical spring, or an adjustable spiral spring, among others, may be used in place of or in conjunction with the constant force spring 86. The handle 22 is movable in a linear direction to an open or extended position (FIG. 8) away from the support surface 78 (i.e., the handle 22 is linearly extensible). In addition, when the handle 22 is extended away from the support surface 78, an opening 82 is defined between the handle portion 18, the handle 22, and the main housing 14. The opening 82 is configured to receive a portion or a lip of the work platform (i.e., boom lift, man lift, basket crane, hydraladder, cherry picker, etc.) or the workpiece. In addition, the size of the opening 82 is such that it can receive a variety of differently sized lips.

In operation, the utility mount light 10 may be attached to a work platform or a workpiece using the handle 22. A user may grasp the gripping portion 66 and the main housing 14, for example, and pull the handle 22 against the bias of the constant force spring 86 toward the open position to disengage contact between the handle 22 and the support surface 78 to create a gap. The handle 22 and support surface 78 may then be placed on opposing sides of a workpiece or a work platform (i.e., a bucket, etc.) and subsequently released such that the bias of the constant force spring 86 pulls the handle 22 toward the support surface 78 to clamp the work platform or workpiece between the handle 22 and the support surface 78. In one embodiment, the movable range of the handle 22 may be limited such that the maximum gap is approximately 3.5 inches.

The utility mount light 10 may be detached from a work platform or workpiece by pulling the handle 22 against the bias of the constant force spring 86 to open a gap between the work platform or workpiece and the handle 22 and/or the support surface 78 (i.e., un-clamp the utility mount light 10 form the work platform or workpiece). However, pulling the handle 22 may not be required in some embodiments. For example, the biasing force of the constant force spring 86 may be set such that the spring 86 retracts the handle and provides the desired clamping/frictional force on the work platform or workpiece, but allows the user to detach the utility mount light 10 from the work platform or workpiece by grasping the handle portion 18 and lifting the utility mount light 10 away from the workpiece. Using this method, a user can remove the light 10 with one hand by simply grasping the handle portion 18 and pulling the light upward.

It should be noted that the placement of the gripping portion 66 of the handle 22 adjacent to the handle portion 18 provides certain advantages. This placement reduces the distance between a gripping portion 66 and the spring, thereby reducing rotational torqueing on the handle 22 and the spring during operation thereby increasing the operational life.

In addition, the linearly displaceable handle 22 advantageously allows the utility light 10 to be coupled to work platforms or workpieces of various sizes (e.g., various widths).

Various features of the invention are set forth in the following claims.

What is claimed is:

1. A utility light mountable to a workpiece, the utility light comprising:

a main body having a first end, a second end opposite the first end, and a length extending between the first end and the second end;

a light assembly coupled to the main body, the light assembly including a light housing and a light source disposed within the light housing, the light housing being pivotable and rotatable relative to the main body;

a battery support portion configured to selectively receive a battery, the battery support portion disposed at the first end of the main body; and a handle assembly coupled to the second end of the main body, the handle assembly having a first member configured to be grasped for carrying and maneuvering the utility light and a second member that is moveable relative to the first member;

wherein the light assembly is disposed above the battery support portion and below the handle assembly with respect to a direction along the length of the main body, wherein the second member of the handle assembly is movable between a retracted position, in which the second member is adjacent the main body, and an extended position, in which an opening is defined between the second member and the main body, and wherein the utility light is supportable on a support surface via the battery support portion.

2. The utility light of claim 1, wherein a portion of the second member of the handle assembly slides into and out of the first member.

3. The utility light of claim 1, wherein the light assembly is a first light assembly, the light source is a first light source, and the light housing is a first light housing, and wherein the utility light further includes a second light assembly having a second light housing and a second light source disposed within the second light housing.

4. The utility light of claim 1, wherein the light housing is supported for pivoting movement via a yoke that is rotatably coupled to the main body.

5. The utility light of claim 4, wherein the yoke is rotatable at least 180 degrees relative to the main body.

6. The utility light of claim 1, wherein the second member is biased to move relative to the first member by a spring.

7. The utility light of claim 6, wherein the spring biases the second member toward the retracted position to exert a clamping force on the workpiece.

8. The utility light of claim 1, wherein the battery support portion includes a cavity and a door to selectively cover the cavity, the door having one end pivotally coupled to the battery support portion and another end releasably secured to the battery support portion via a latch.

9. The utility light of claim 8, wherein the latch is an over-center latch.

10. The utility light of claim 8, wherein the battery support portion includes a seal that engages the door to inhibit water from entering the cavity.

11. A utility light mountable to a bucket of a bucket truck, the utility light comprising:

a main body having a first end, a second end opposite the first end, and a length extending between the first end and the second end;

a light assembly coupled to the main body, the light assembly including a light housing and a light source disposed within the light housing, the light housing being pivotable and rotatable relative to the main body;

a handle coupled to the second end of the main body and defining a gripping portion configured to be grasped for carrying and maneuvering the utility light, wherein the handle is oriented perpendicular to the length of the main body; and a power actuator disposed on the handle, wherein the power actuator is depressible along a direction substantially parallel to the length of the main body, wherein the light assembly is disposed below the handle with respect to a direction along the length of the main body, wherein the utility light is battery powered.

12. The utility light of claim 11, further comprising a battery support portion configured to selectively receive a battery, wherein the battery support portion is disposed at the first end of the main body.

13. The utility light of claim 12, wherein battery support portion includes a cavity and a door to selectively cover the cavity, wherein the cavity is configured to receive the battery, and wherein the door is releasably secured to the battery support portion via a latch to enclose the battery within the cavity.

14. The utility light of claim 13, wherein the battery support portion includes a seal that engages the door to inhibit water from entering the cavity.

15. The utility light of claim 12, wherein the light assembly is disposed above the battery support portion with respect to the direction along the length of the main body.

16. The utility light of claim 12, wherein the utility light is supportable on a support surface via the battery support portion.

17. The utility light of claim 11, wherein the light assembly is a first light assembly, the light source is a first light source, and the light housing is a first light housing, and wherein the utility light further includes a second light assembly having a second light housing and a second light source disposed within the second light housing.

18. The utility light of claim 11, wherein the light housing is supported for pivoting movement via a yoke that is rotatably coupled to the main body.

19. The utility light of claim 18, wherein the yoke is rotatable at least 180 degrees relative to the main body.

20. A utility light mountable to a bucket of a bucket truck, the utility light comprising:

a main body having a first end, a second end opposite the first end, and a length extending between the first end and the second end;

a light assembly coupled to the main body, the light assembly including a light housing and a light source disposed within a light housing, the light housing being movable in two degrees of freedom relative to the main body;

a battery support portion disposed at the first end of the main body;

a door having one end pivotally coupled to the battery support portion and another end releasably secured to the battery support portion via a latch; and a handle coupled to the second end of the main body and defining a gripping portion that is oriented perpendicular to the length of the main body, wherein the light assembly is disposed above the battery support portion and below the handle with respect to a direction along the length of the main body.

* * * * *